US008662923B2

(12) United States Patent
Wu

(10) Patent No.: US 8,662,923 B2
(45) **Date of Patent: *Mar. 4, 2014**

(54) ELECTRICAL PLUG CONNECTOR, ELECTRICAL SOCKET CONNECTOR, ELECTRICAL PLUG AND SOCKET CONNECTOR ASSEMBLY

(75) Inventor: Kun-Shen Wu, Taoyuan County (TW)

(73) Assignee: Aces Electronics Co., Ltd., Jhongli, Taoyuan County (TW)

( * ) Notice: Subject to any disclaimer, the term of this patent is extended or adjusted under 35 U.S.C. 154(b) by 83 days.

This patent is subject to a terminal disclaimer.

(21) Appl. No.: 13/529,752

(22) Filed: Jun. 21, 2012

(65) Prior Publication Data

US 2013/0052880 A1 Feb. 28, 2013

(30) Foreign Application Priority Data

Aug. 26, 2011 (TW) ..... 100216036 U

(51) Int. Cl.
*H01R 13/40* (2006.01)

(52) U.S. Cl.
USPC ..... 439/595; 439/947

(58) Field of Classification Search
USPC ..... 439/682, 78, 79, 660, 507, 825, 907, 439/947, 595, 378
See application file for complete search history.

(56) References Cited

U.S. PATENT DOCUMENTS 4,818,237 A * 4/1989 Weber ..... 439/693
5,147,228 A * 9/1992 Miller et al. ..... 439/741
5,158,471 A * 10/1992 Fedder et al. ..... 439/80
5,360,349 A * 11/1994 Provencher et al. ..... 439/108
5,582,519 A * 12/1996 Buchter ..... 439/101
5,630,720 A * 5/1997 Kocher ..... 439/78
5,865,651 A * 2/1999 Dague et al. ..... 439/680
6,203,335 B1 * 3/2001 Chang ..... 439/79
6,210,240 B1 * 4/2001 Comerci et al. ..... 439/853
6,319,075 B1 * 11/2001 Clark et al. ..... 439/825
6,394,818 B1 * 5/2002 Smalley, Jr. ..... 439/79
6,402,566 B1 * 6/2002 Middlehurst et al. ..... 439/699.1
6,431,886 B1 * 8/2002 Ramey et al. ..... 439/101
6,471,523 B1 * 10/2002 Shuey ..... 439/63
6,488,549 B1 * 12/2002 Weller et al. ..... 439/856
6,672,884 B1 * 1/2004 Toh et al. ..... 439/79
6,780,027 B2 * 8/2004 Allison ..... 439/79
6,814,590 B2 * 11/2004 Minich et al. ..... 439/79
6,832,931 B1 * 12/2004 Wu ..... 439/499
6,848,950 B2 * 2/2005 Allison et al. ..... 439/682
6,908,330 B2 * 6/2005 Garrett et al. ..... 439/378
7,001,189 B1 * 2/2006 McGowan et al. ..... 439/79
7,104,812 B1 * 9/2006 Bogiel et al. ..... 439/79
7,303,401 B2 * 12/2007 Schell et al. ..... 439/65

(Continued)

*Primary Examiner* — Neil Abrams
*Assistant Examiner* — Phuongchi T Nguyen
(74) *Attorney, Agent, or Firm* — Muncy, Geissler, Olds & Lowe, PLLC

(57) ABSTRACT

An electrical plug and socket connector assembly includes an electrical plug connector and an electrical socket connector each including an electrically insulative housing and conducting terminals inserted into respective insertion slots in the electrically insulative housing, the electrically insulative housing having springy hooks suspending in top and bottom sides in each insertion slot, each conducting terminal of each of the electrical plug connector and electrical socket connector defines two side panels spaced by a gap, multiple fins extended from top and bottom edges of the side panels and suspending in top and bottom sides of the gap and hooked in the insertion slots by the springy hooks, and two contact end portions respectively forwardly extended from respective opposite ends of the two side panels.

9 Claims, 14 Drawing Sheets

(56) References Cited

U.S. PATENT DOCUMENTS

| | | | | |
|---|---|---|---|---|
| 7,314,377 | B2 * | 1/2008 | Northey et al. | 439/79 |
| 7,402,064 | B2 * | 7/2008 | Daily et al. | 439/290 |
| 7,488,217 | B2 * | 2/2009 | Cheng et al. | 439/668 |
| 7,549,892 | B2 * | 6/2009 | Sawyers et al. | 439/500 |
| 7,597,573 | B2 * | 10/2009 | Defibaugh et al. | 439/206 |
| 7,666,025 | B2 * | 2/2010 | Cheng et al. | 439/485 |
| 7,775,822 | B2 * | 8/2010 | Ngo et al. | 439/290 |
| 7,905,731 | B2 * | 3/2011 | Ngo et al. | 439/75 |
| 7,980,860 | B2 * | 7/2011 | Yu et al. | 439/65 |
| 8,096,814 | B2 * | 1/2012 | Schell et al. | 439/79 |
| 8,317,535 | B2 * | 11/2012 | Yasui | 439/378 |

* cited by examiner

ELECTRICAL PLUG CONNECTOR, ELECTRICAL SOCKET CONNECTOR, ELECTRICAL PLUG AND SOCKET CONNECTOR ASSEMBLY

This application claims the priority benefit of Taiwan patent application number 100216036, filed on Aug. 26, 2011.

BACKGROUND OF THE INVENTION

1. Field of the Invention

The present invention relates to electrical connector technology and more particularly, to an electrical plug and socket connector assembly, which, subject to its smart structural design, facilitates installation and has high structural stability.

2. Description of the Related Art

When designing an electrical connector for joining electrical circuits, a designer will pay attention to the two basic parts, i.e., signal and power supply. When designing a signal circuit, a designer normally will not consider the factor of current variation for the reason that the applied current is normally low. However, with respect to the transmission of signals, a designer usually will consider the nature of the carrier (high frequency, low frequency) and many other factors (static interference, magnetic interference, impedance matching, etc.) without taking the factor of temperature into account. With respect to power supply, conducting a high-current power supply through a power circuit will increase the impedance, causing a rise in temperature. Thus, when designing an electrical power connector for joining power circuits, the factors of quick heat dissipation and low conducting terminal impedance must be considered, avoiding a significant change in the electrical characteristics. Further, an electrical connector of this kind is adapted for conducting power supply, its structural stability is quite important.

Therefore, how to improve the drawbacks of conventional electrical plug and socket connectors is the task people engaged in this industry shall take.

SUMMARY OF THE INVENTION

The present invention has been accomplished under the circumstances in view. It is therefore the main object of the present invention to provide an electrical plug and socket connector assembly, which facilitates installation and has high structural stability.

To achieve this and other objects of the present invention, an electrical plug and socket connector assembly comprises an electrical plug connector and an electrical socket connector. The electrical plug connector and the electrical socket connector each comprise an electrically insulative housing and a plurality of conducting terminals mounted in the electrically insulative housing. The electrically insulative housing comprises a plurality of insertion slots and terminal holes for receiving the conducting terminals, and a plurality of springy hooks suspending in top and bottom sides in the insertion slots. Each conducting terminal of each of the electrical plug connector and electrical socket connector comprises two side panels spaced by a gap, multiple fins extended from top and bottom edges of the side panels and suspending in top and bottom sides of the gap and hooked in the insertion slots by the springy hooks, and two contact end portions respectively forwardly extended from respective opposite ends of the two side panels. Further, each springy hook comprises a bevel face located on a distal end thereof remote from the associating terminal hole, a vertical stop edge disposed at a back side of the bevel face and a stepped rear stop portion disposed adjacent to the associating terminal hole. When inserting the conducting terminals into the respective insertion slots in the electrically insulative housing, the fins will be moved over the respective bevel faces of the springy hook into the space between the vertical stop edges and stepped rear stop portions of the respective springy hooks and then positively stopped between the vertical stop edges and stepped rear stop portions of the respective springy hooks, prohibiting the respective conducting terminals from forward and backward displacement relative to the electrically insulative housing. Thus, the electrical plug connector and the electrical socket connector have the characteristics of ease of installation and high positioning stability.

Further, the fins of the conducting terminals, except the function for engagement with the springy hooks, increase the heat radiation surface area of the conducting terminals.

DETAILED DESCRIPTION OF THE PREFERRED EMBODIMENT

Figure 1:
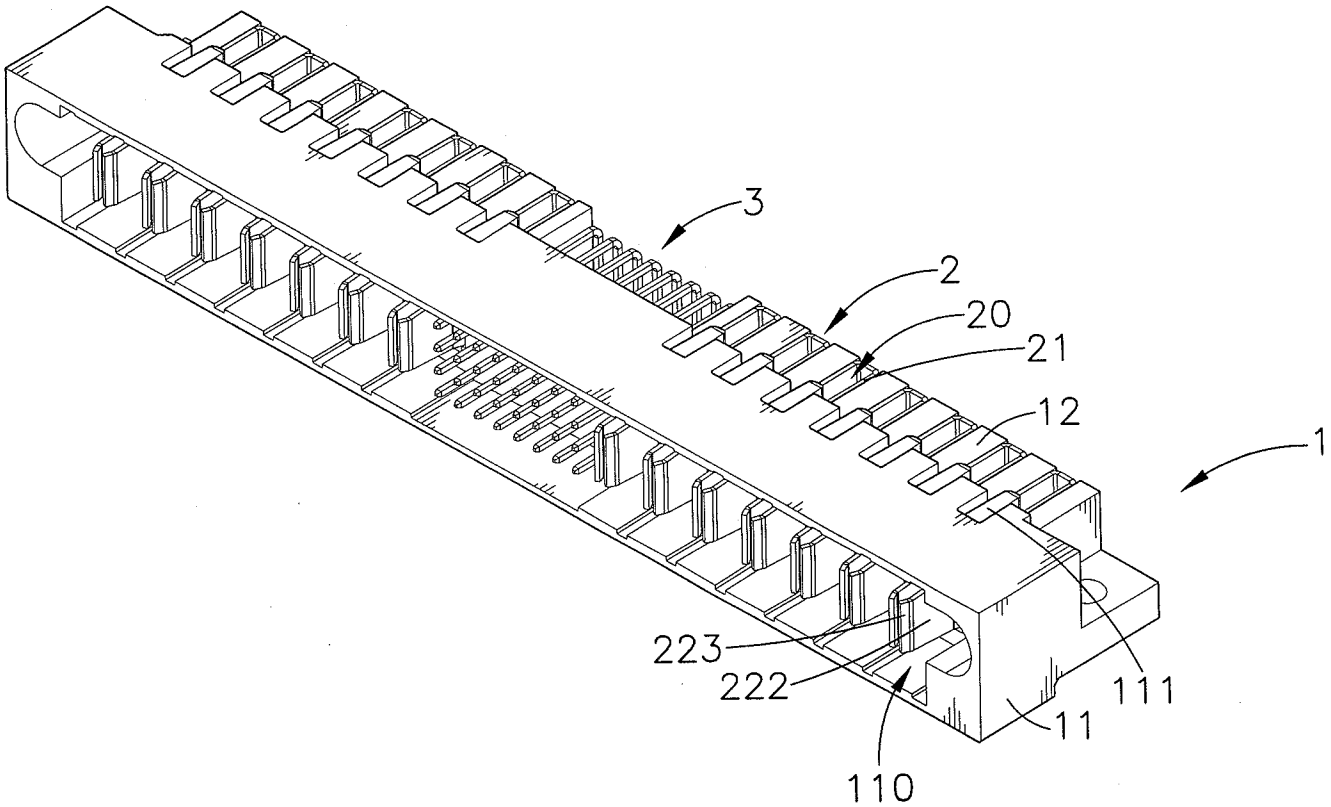
FIG. 1 is an elevational view of an electrical plug connector in accordance with the present invention.
Figure 2:
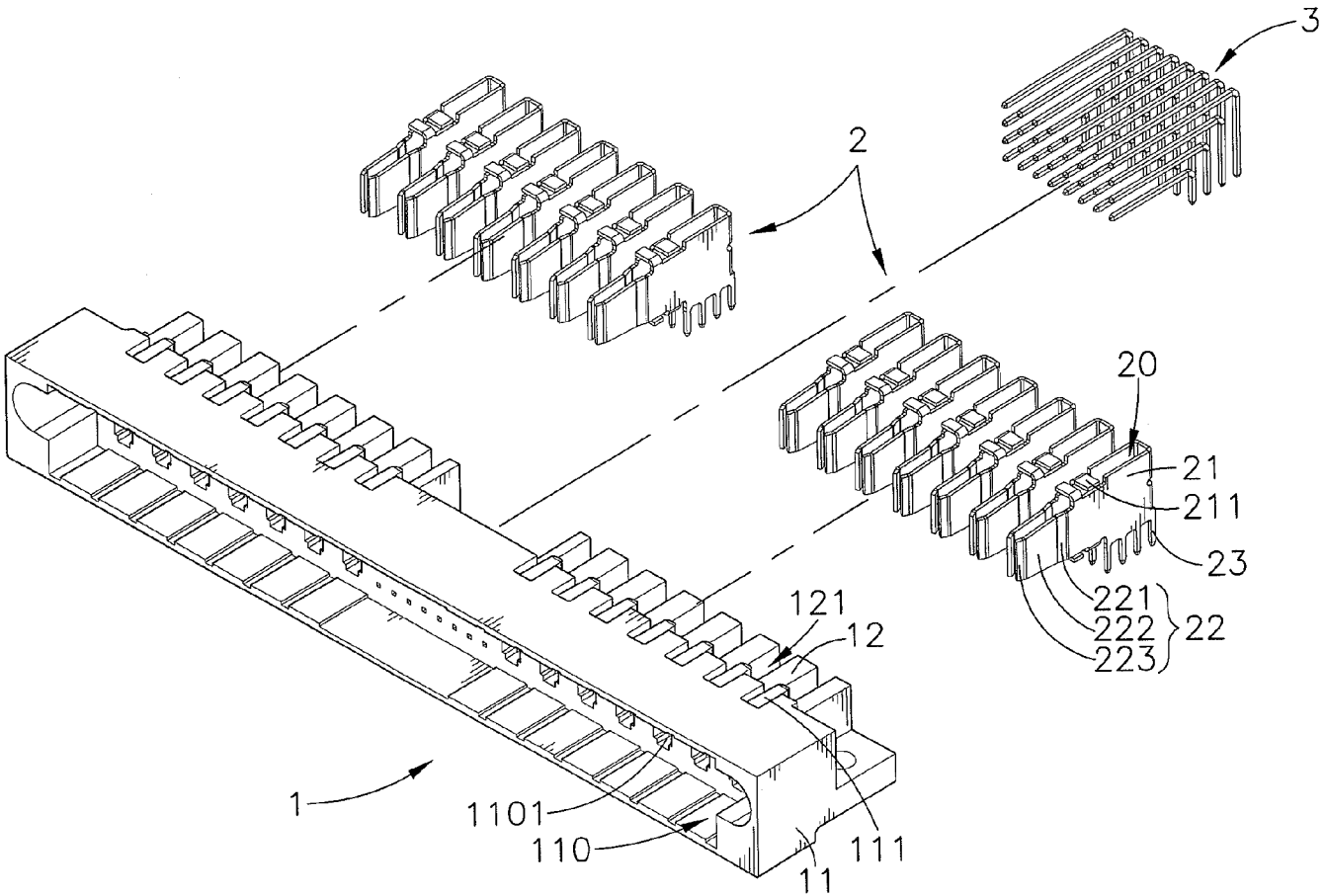
FIG. 2 is an exploded view of the electrical plug connector in accordance with the present invention.
Figure 3:
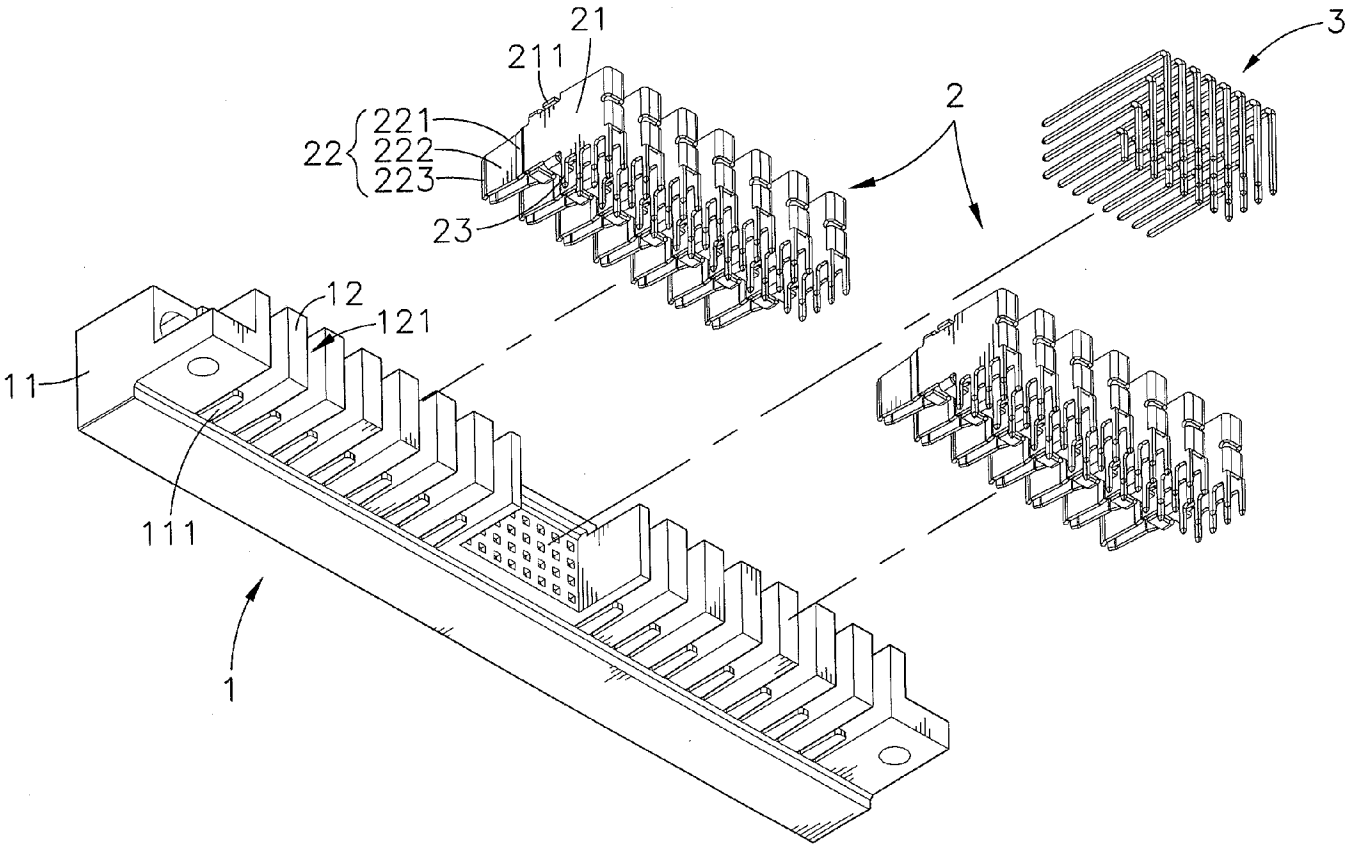
FIG. 3 corresponds to FIG. 2 when viewed from another angle.
Figure 4:
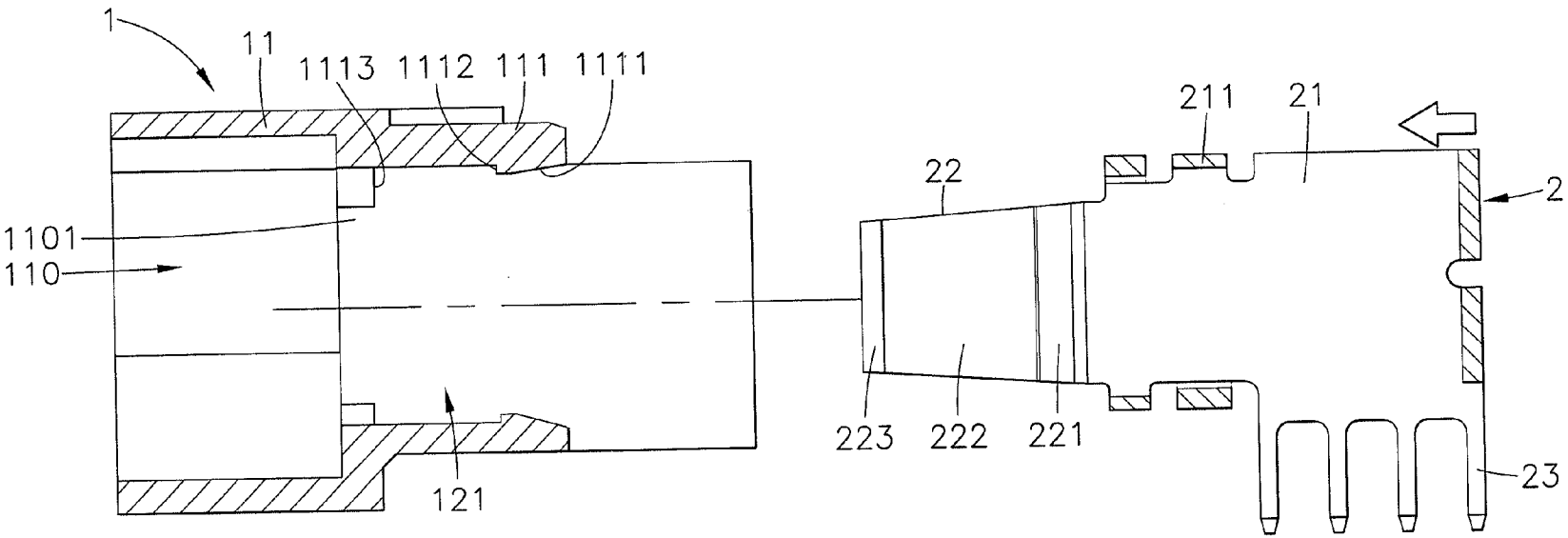
FIG. 4 is an exploded sectional side view of the electrical plug connector according to the present invention.
Figure 5:
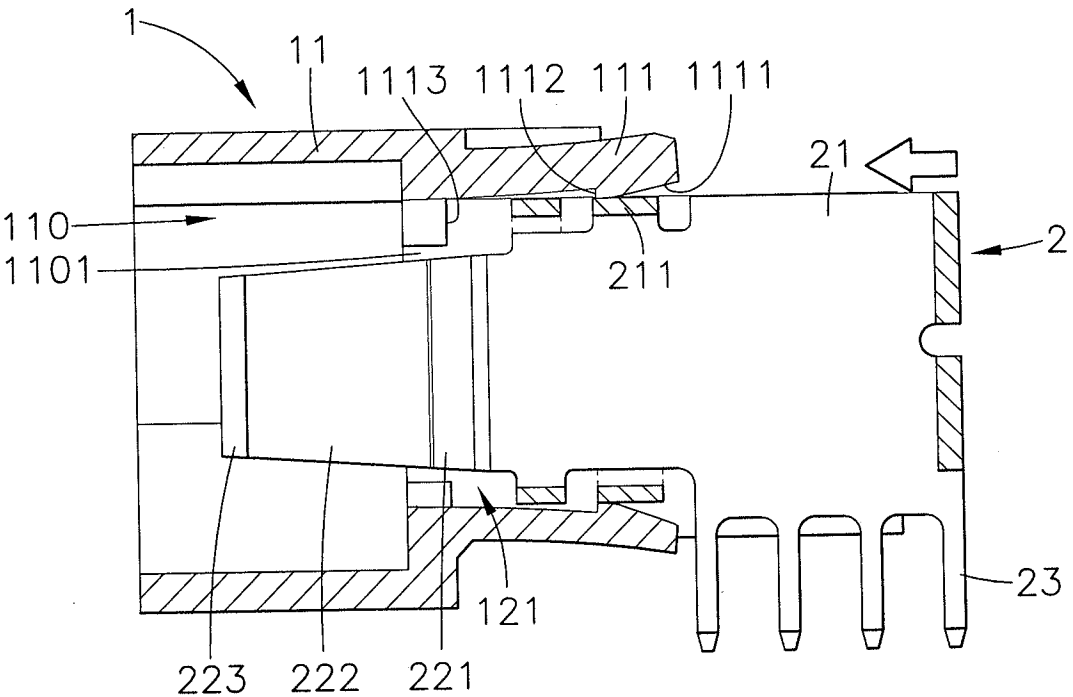
FIG. 5 is a schematic sectional side view illustrating the conducting terminal of the electrical plug connector partially inserted into the electrically insulative housing according to the present invention.
Figure 6:
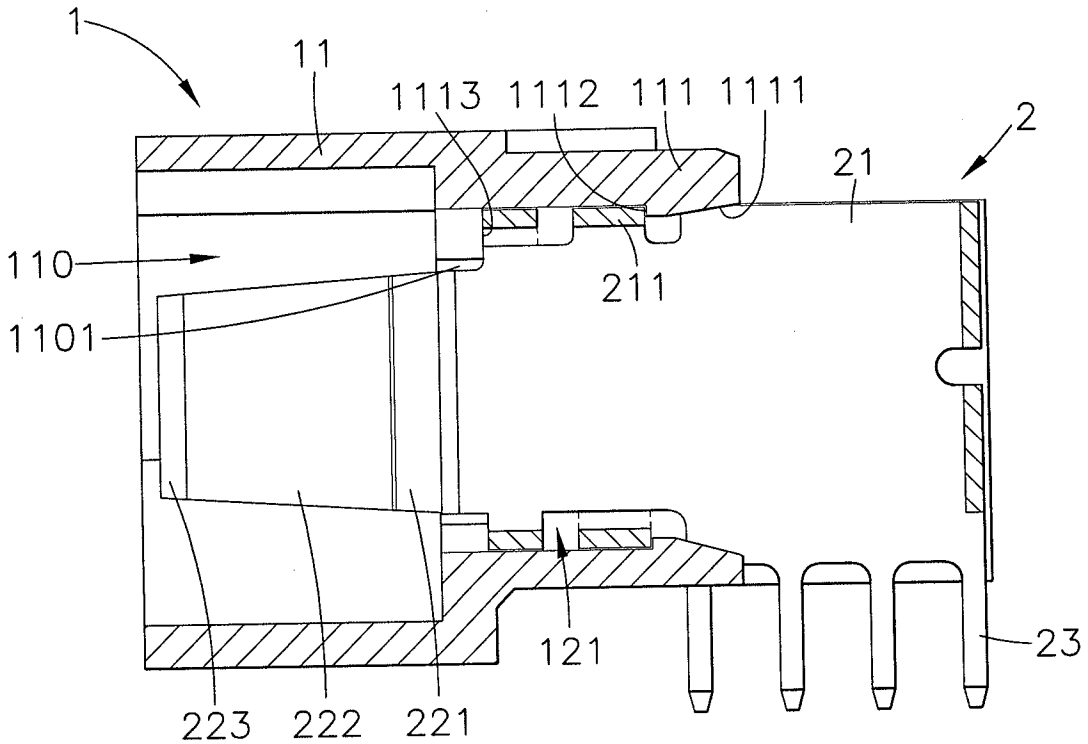
FIG. 6 corresponds to FIG. 5, illustrating the conducting terminals completely set in position in the electrically insulative housing.

Referring to FIGS. 1, 2 and 3, an electrical plug connector in accordance with the present invention is shown comprising an electrically insulative housing 1, and a plurality of conducting terminals 2.

The electrically insulative housing 1 comprises a mating portion 11, a receiving chamber 110 defined in one side of the mating portion 11, a plurality of partition plates 12 arranged in two sets at an opposite side of the mating portion 11, a plurality of insertion slots 121 respectively defined between each two adjacent partition plates 12 of each of the two sets of partition plates 12, a plurality of terminal holes 1101 formed in the mating portion 11 and respectively disposed in communication between the insertion slots 121 and the receiving chamber 110, and a plurality of springy hooks 111 extended from the mating portion 11 and respectively suspending in top and bottom sides in each of the insertion slots 12. Further, the terminal holes 1101 have a relatively shorter height than the insertion slots 121. Further, each springy hook 111 defines a bevel face 1111 located on a distal end thereof remote from the associating terminal hole 1101, a vertical stop edge 1112 disposed at a back side of the bevel face 1111, and a stepped rear stop portion 1113 disposed adjacent to the associating terminal hole 1101.

The conducting terminals 2 are respectively mounted in the insertion slots 121 of the electrically insulative housing 1. Each conducting terminal 2 comprises two side panels 21 arranged in a substantially parallel manner and defining therebetween a gap 20, two contact end portions 22 respectively forwardly extended from respective opposite ends of the two side panels 21 and engaged into one respective terminal hole 1101, a plurality of fins 211 respectively extended from opposing top and bottom edges of the two side panels 21 and suspending in top and bottom sides of the gap 20, and a plurality of bonding pegs 23 respectively downwardly extended from respective bottom edges of the side panels 21. Further, each contact end portion 22 defines a rear inflection surface 221 obliquely inwardly extended from the associating side panel 21, a middle planar surface 222 forwardly extended from the rear inflection surface 221, and an inwardly inclined front guide surface 223 inwardly extended from a front side of the middle planar surface 222 opposite the rear inflection surface 221.

Figure 7:
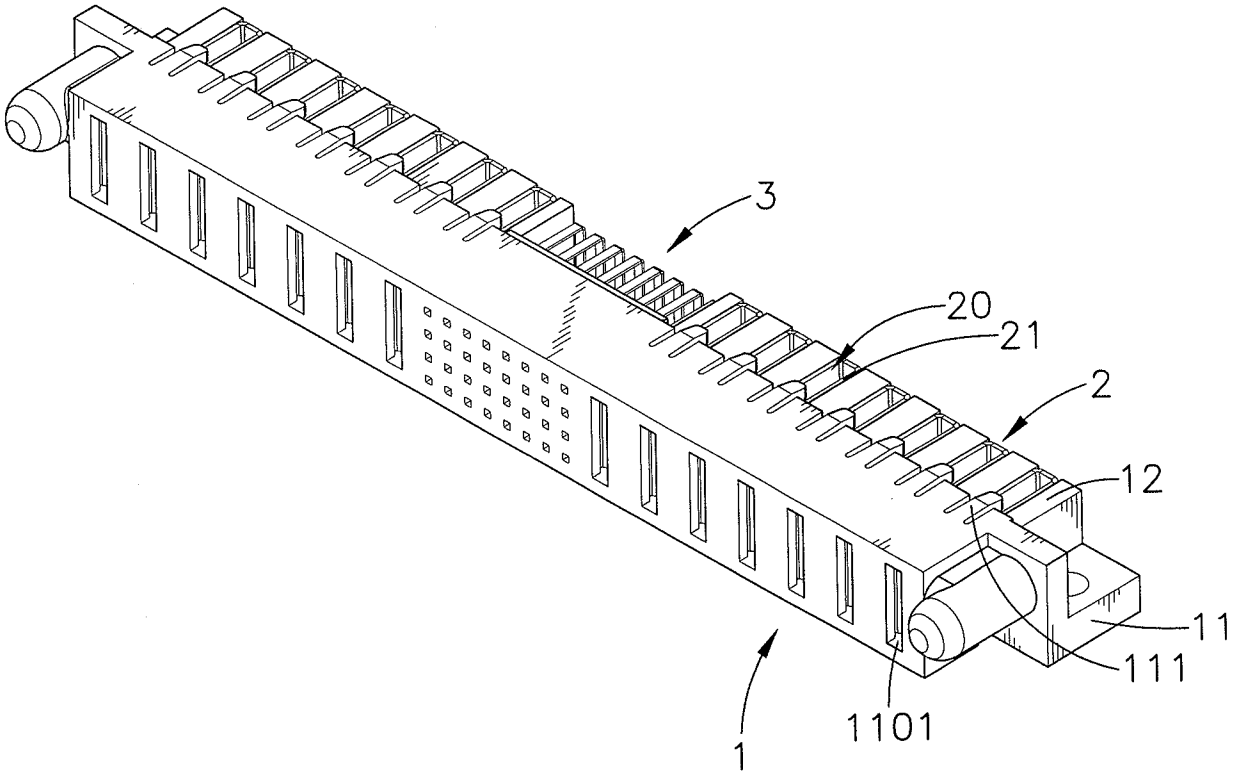
FIG. 7 is an elevational view of an electrical socket connector in accordance with the present invention.
Figure 8:
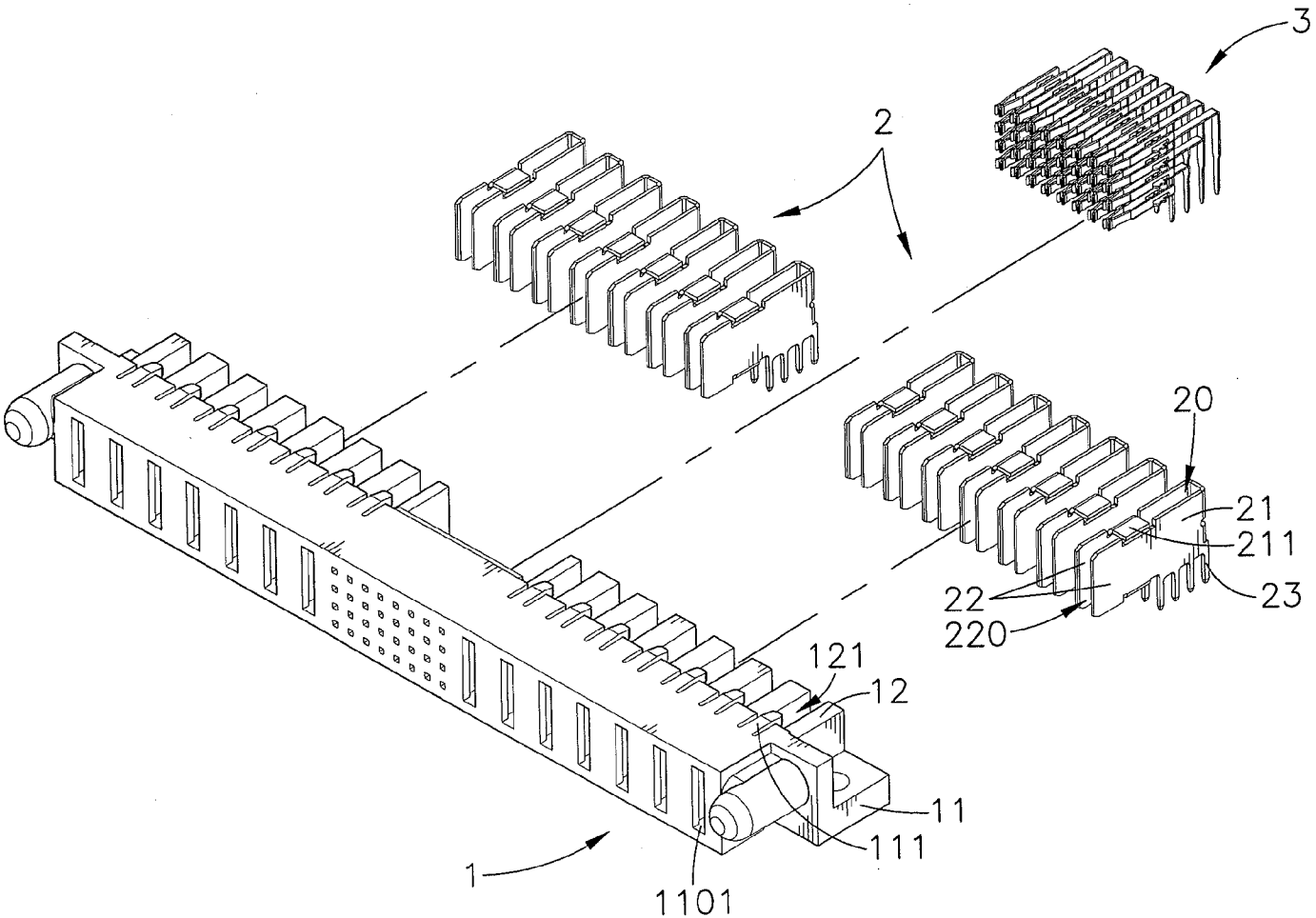
FIG. 8 is an exploded view of the electrical socket connector in accordance with the present invention.
Figure 9:
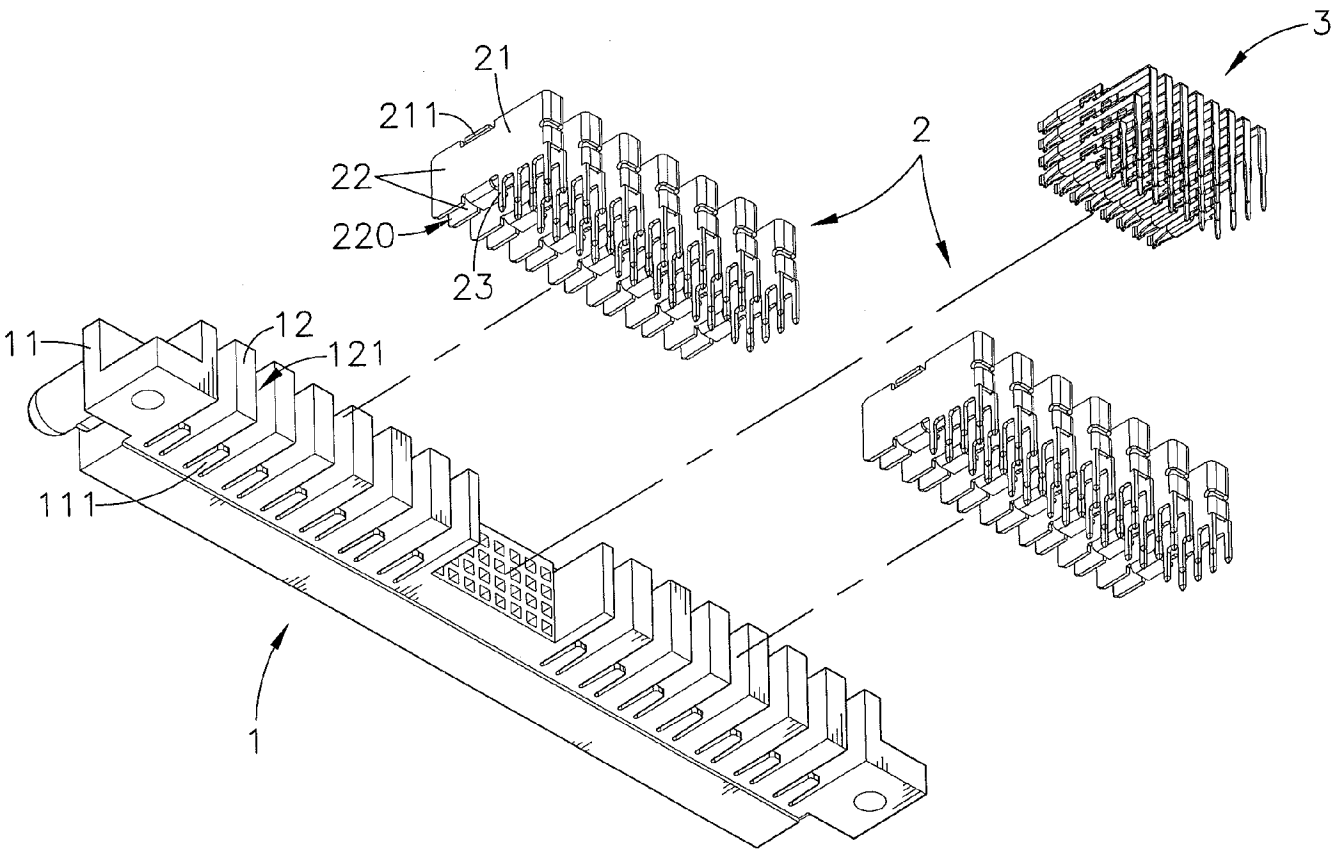
FIG. 9 corresponds to FIG. 8 when viewed from another angle.
Figure 10:
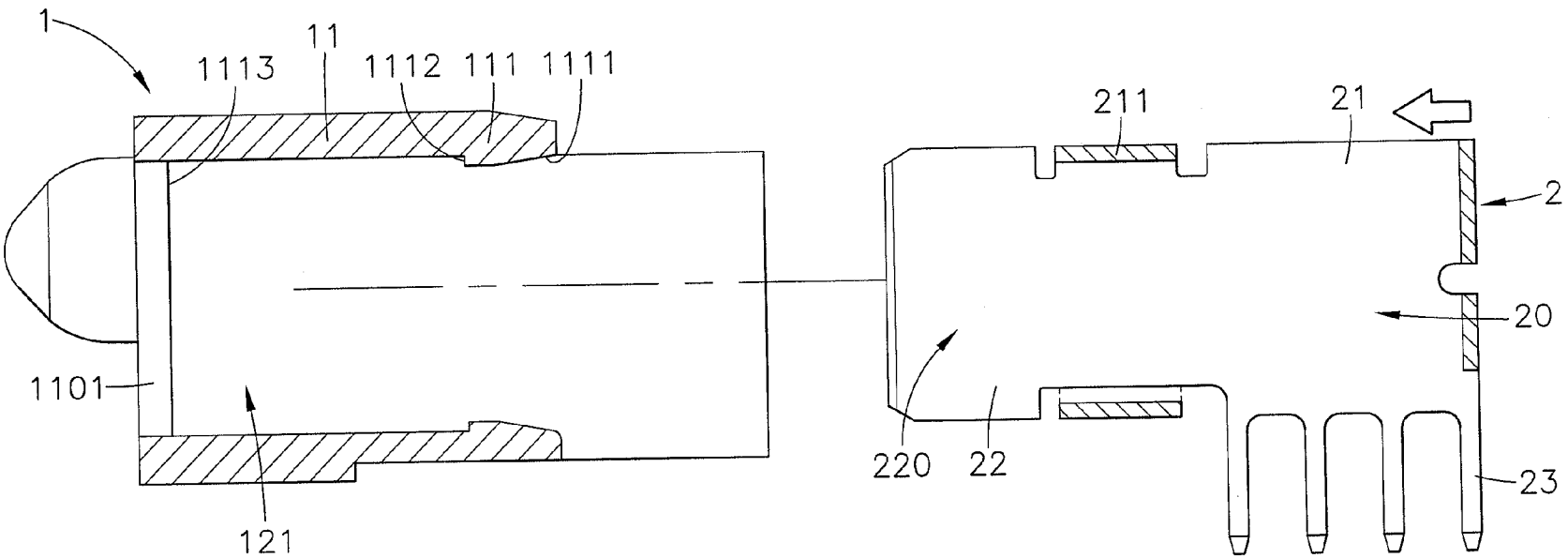
FIG. 10 is an exploded sectional side view of the electrical socket connector according to the present invention.
Figure 11:
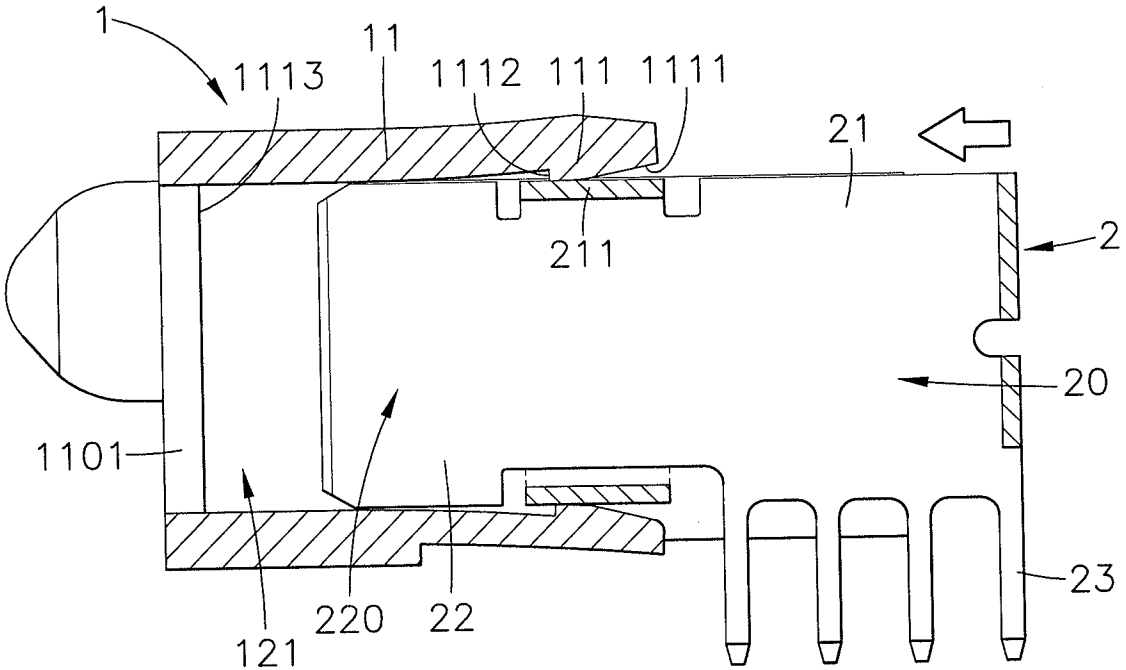
FIG. 11 is a schematic sectional side view illustrating the conducting terminal of the electrical socket connector partially inserted into the electrically insulative housing according to the present invention.
Figure 12:
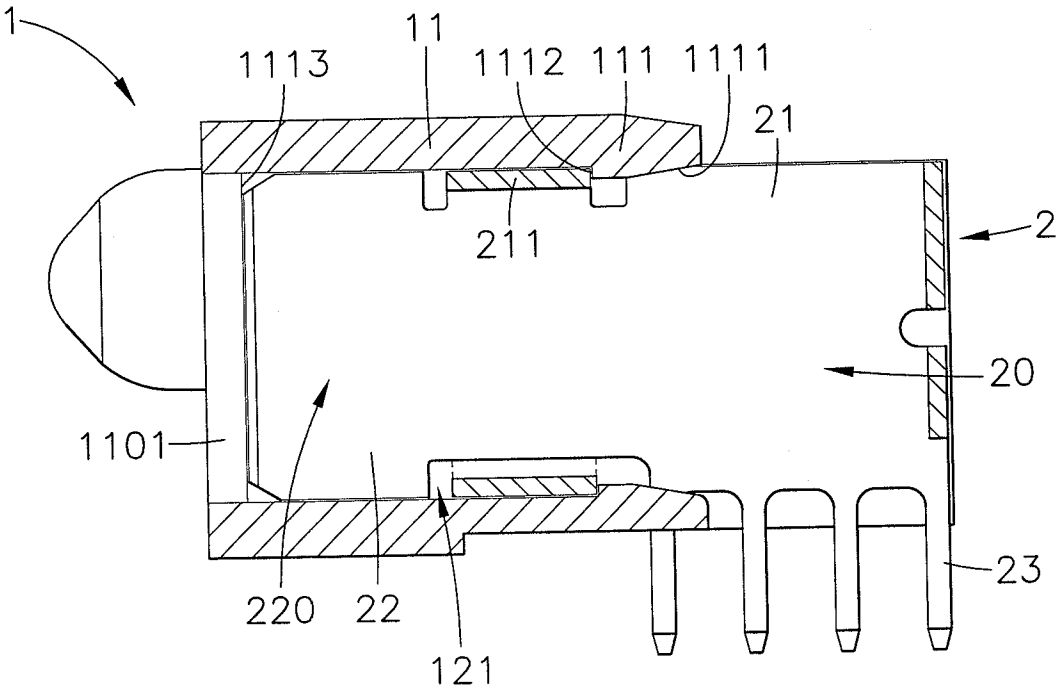
FIG. 12 corresponds to FIG. 11, illustrating the conducting terminals completely set in position in the electrically insulative housing.

Referring to FIGS. 7, 8, and 9, an electrical socket connector in accordance with the present invention is shown comprising an electrically insulative housing 1, and a plurality of conducting terminals 2.

The electrically insulative housing 1 comprises a mating portion 11, a plurality of partition plates 12 arranged in two sets at a rear side of the mating portion 11, a plurality of insertion slots 121 respectively defined between each two adjacent partition plates 12 of each of the two sets of partition plates 12, a plurality of terminal holes 1101 formed in a front side of the mating portion 11 and respectively disposed in communication with the insertion slots 121, and a plurality of springy hooks 111 extended from the mating portion 11 and respectively suspending in top and bottom sides in each of the insertion slots 12. Further, the terminal holes 1101 have a relatively shorter height than the insertion slots 121. Further, each springy hook 111 defines a bevel face 1111 located on a distal end thereof remote from the associating terminal hole 1101, a vertical stop edge 1112 disposed at a back side of the bevel face 1111, and a stepped rear stop portion 1113 disposed adjacent to the associating terminal hole 1101.

The conducting terminals 2 are respectively mounted in the insertion slots 121 of the electrically insulative housing 1. Each conducting terminal 2 comprises two side panels 21 arranged in a substantially parallel manner and defining therebetween a gap 20, two contact end portions 22 respectively forwardly extended from respective front ends of the two side panels 21 and inserted into one respective terminal hole 1101, a receiving space 220 defined between the two contact end portions 22 in communication with the gap 20 between the two side panels 21 for receiving one respective conducting terminal of the electrical plug connector, a plurality of fins 211 respectively extended from opposing top and bottom edges of the two side panels 21 and respectively suspending in top and bottom sides of the gap 20, and a plurality of bonding pegs 23 respectively downwardly extended from respective bottom edges of the side panels 21.

The electrical plug connector and the electrical socket connector are respectively formed of a substantially similar electrical insulative housing 1 and substantially similar conducting terminals 2 with the exceptions of the configuration of the receiving chamber 110 of the electrical insulative housing 1 and the configuration of the contact end portions 22 of the conducting terminals 2. Thus, wherever possible, like reference numbers are used in the drawings and the description to refer to like parts.

Referring to FIGS. 2, 4-6, 8, and 10-12, when assembling the electrical plug connector or electrical socket connector, insert the contact end portions 22 of the respective conducting terminals 2 into the respective insertion slots 121 of the electrically insulative housing 1. When the fins 211 of the conducting terminals 2 touch the bevel faces 1111 of the respective springy hooks 111 in the respective insertion slots 121 during forward movement of the contact end portions 22 of the respective conducting terminals 2 into the respective insertion slots 121, the respective springy hooks 111 will be elastically deformed and outwardly curved, enabling the fins 211 to be moved over the respective bevel faces 1111 into the space between the vertical stop edges 1112 and stepped rear stop portions 1113 of the respective springy hooks 111. After the fins 211 are moved over the respective bevel faces 1111 into the space between the vertical stop edges 1112 and stepped rear stop portions 1113 of the respective springy hooks 111, the respective springy hooks 111 immediately return to their former shape, and therefore the fins 211 are positively stopped between the vertical stop edges 1112 and stepped rear stop portions 1113 of the respective springy hooks 111, prohibiting the respective conducting terminals 2 from forward and backward displacement relative to the electrically insulative housing 1. Thus, the electrical plug connector and the electrical socket connector have the characteristics of ease of installation and high positioning stability.

Figure 14:
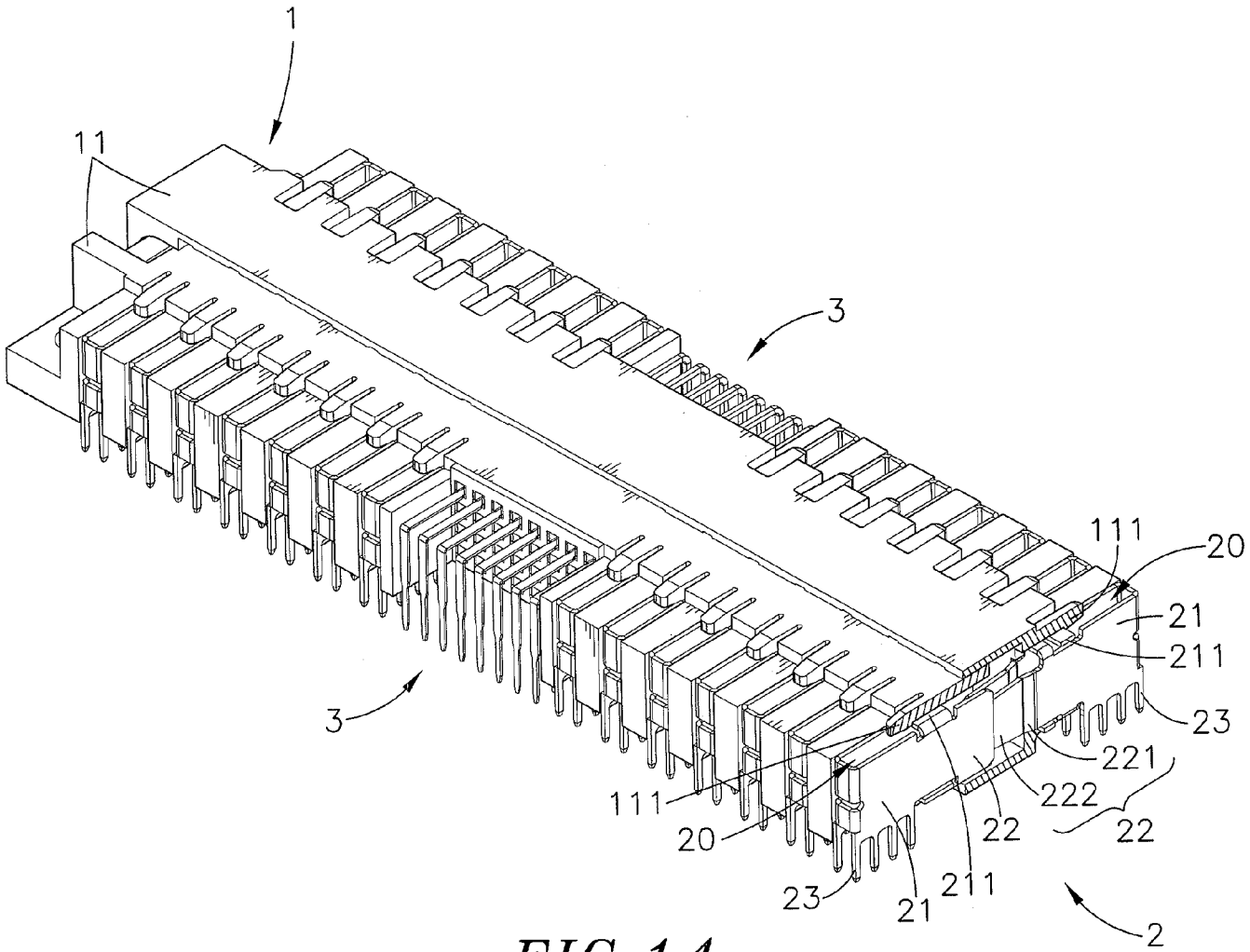
FIG. 14 is an assembly view of the electrical plug and socket connector assembly in accordance with the present invention.

Referring to FIGS. 7, 8 and 14, when a high heat is developed upon conduction of a high-current power supply through the conducting terminals 2, developed heat can be quickly dissipated through the respective gaps 20 in the insertion slots 121 into the atmosphere. Further, subject to the operation of an electric fan to create a cooling current of air through the connected electrical plug connector and electrical socket connector, the conducting terminals 2 are maintained within a predetermined operating temperature range, avoiding a significant change in the electrical characteristics of the conducting terminals 2.

Figure 13:
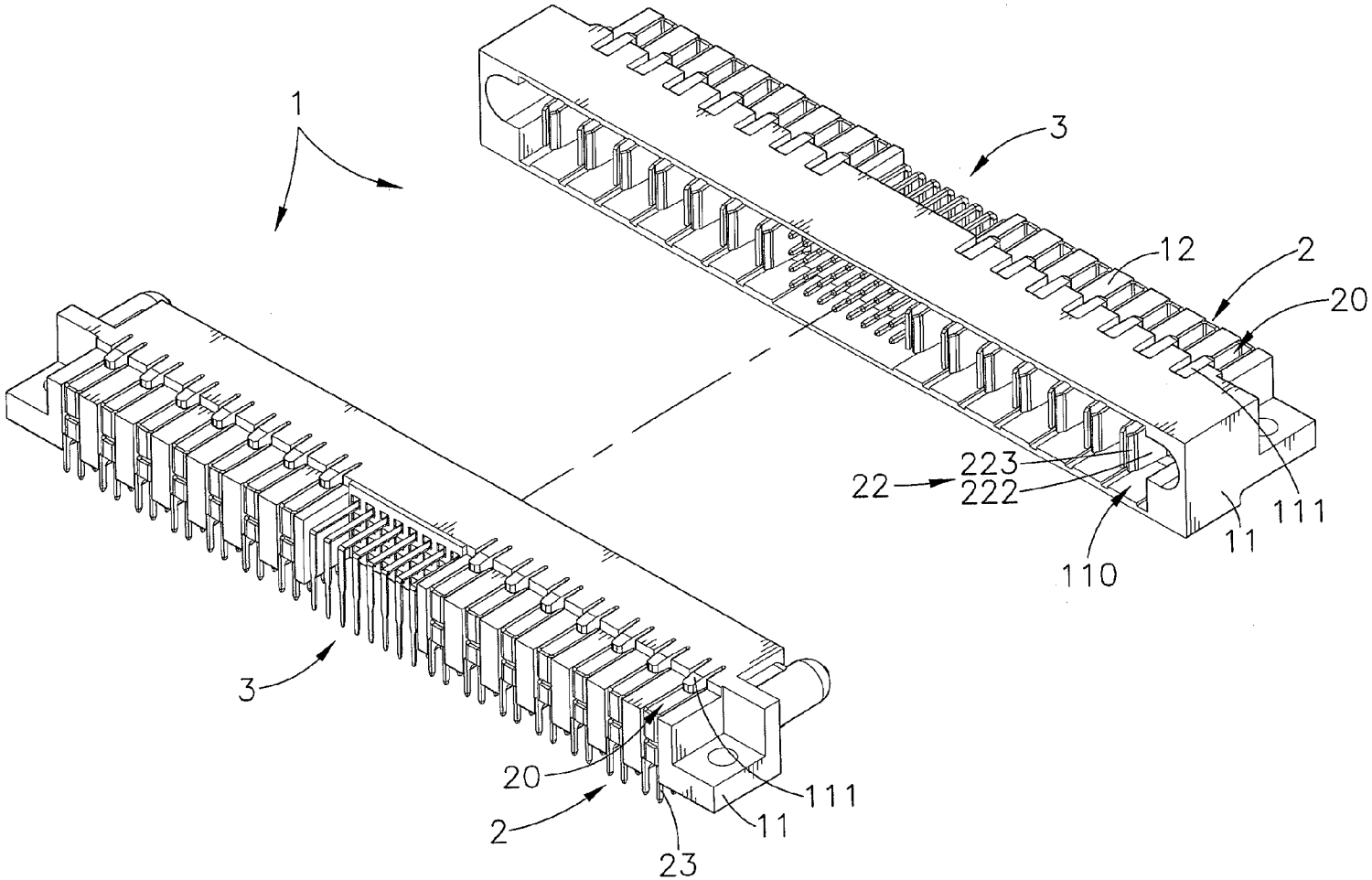
FIG. 13 is an exploded view of an electrical plug and socket connector assembly in accordance with the present invention.

Referring to FIGS. 13 and 14, when the electrical plug connector and the electrical socket connector are connected together and a high-current power supply is conducting through the conducting terminals 2, the two side panels 21 of each conducting terminal 2 of the electrical plug connector are kept in positive contact with the inner surfaces of the side panels 21 of the mating conducting terminal 2 of the electrical socket connector, lowering the impedance and temperature, smoothing conduction of power supply and assuring a high level of safety.

Referring to FIGS. 2, 8, 13 and 14, the electrical plug connector and the electrical socket connector each further comprise a plurality of signal terminals 3 for transmitting data signals. As the signal terminals 3 are not within the spirit and scope of the invention, not further detailed description will be provided.

Referring to FIGS. 2, 3, 8 and 9, each fin 211 of each conducting terminal 2 perpendicularly extended from the top or bottom edge of one side panel 21 toward the other side panel 21. Further, the fins 211 can be alternatively extended from the two side panels 21. Further, the number of the fins 211 of the conducting terminals 2 can be increased to fit different requirements.

Referring to FIGS. 2, 6, 8 and 12, the main feature of the present invention is the design of the springy hooks 111 in top and bottom sides in each of the insertion slots 12 and the design of the fins 211 of each conducting terminal 2, wherein when the conducting terminals 2 are respectively inserted into the insertion slots 121 and terminal holes 1101 of the electrically insulative housing 1, the fins 211 of the conducting terminals 2 are positively stopped between the vertical stop edges 1112 and stepped rear stop portions 1113 of the respective springy hooks 111, prohibiting the respective conducting terminals 2 from forward and backward displacement relative to the electrically insulative housing 1.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical plug connector, comprising:

an electrically insulative housing comprising a mating portion, a receiving chamber defined in one side of said mating portion, a plurality of partition plates arranged in two sets at an opposite side of said mating portion, a plurality of insertion slots respectively defined between each two adjacent said partition plates of each of said two sets of partition plates, a plurality of terminal holes formed in said mating portion and respectively disposed in communication between said insertion slots and said receiving chamber, and a plurality of springy hooks extended from said mating portion and respectively suspending in top and bottom sides in each of said insertion slots; and a plurality of conducting terminals respectively mounted in said insertion slots of said electrically insulative housing, each said conducting terminal comprising two side panels arranged in a substantially parallel manner and defining therebetween a gap, a connection portion connected between one end of each of said two side panels, two contact end portions respectively forwardly extended from respective opposite ends of said two side panels and engaged into one respective terminal hole, a plurality of fins respectively extended from opposing top and bottom edges of said side panels and hooked in said insertion slots by said springy hooks, and a plurality of bonding pegs respectively downwardly extended from respective bottom edges of said side panels;

wherein said fins are extended from the two opposite topmost edges of said side panels towards each other and arranged alternatively.

2. The electrical plug connector as claimed in claim 1, wherein each contact end portion of each said conducting terminal defines a rear inflection surface obliquely inwardly extended from the associating said side panel, a middle planar surface forwardly extended from said rear inflection surface, and an inwardly inclined front guide surface inwardly extended from a front side of said middle planar surface opposite to said rear inflection surface.

3. The electrical plug connector as claimed in claim 1, wherein each said springy hook comprises a bevel face located on a distal end thereof remote from the associating said terminal hole, a vertical stop edge disposed at a back side of said bevel face and a stepped rear stop portion disposed adjacent to the associating said terminal hole.

4. An electrical socket connector, comprising:

an electrically insulative housing comprising a mating portion, a plurality of partition plates arranged in two sets at a rear side of said mating portion, a plurality of insertion slots respectively defined between each two adjacent said partition plates of each of said two sets of partition plates, a plurality of terminal holes formed in a front side of said mating portion and respectively disposed in communication with said insertion slots, and a plurality of springy hooks extended from said mating portion and respectively suspending in top and bottom sides in each of said insertion slots; and a plurality of conducting terminals respectively mounted in said insertion slots of said electrically insulative housing, each said conducting terminal comprising two side panels arranged in a substantially parallel manner and defining therebetween a gap, a connection portion connected between respective rear ends of said two side panels, two contact end portions respectively forwardly extended from respective front ends of said two side panels and inserted into one respective said terminal hole, a receiving space defined between said two contact end portions in communication with said gap between said two side panels for receiving one respective conducting terminal of a mating electrical plug connector, a plurality of fins respectively extended from opposing top and bottom edges of said side panels and hooked in said insertion slots by said springy hooks, a plurality of bonding pegs respectively downwardly extended from respective bottom edges of said side panels;

wherein said fins are extended from the two opposite topmost edges of said side panels towards each other and arranged alternatively.

5. The electrical socket connector as claimed in claim 4, wherein each said springy hook comprises a bevel face located on a distal end thereof remote from the associating said terminal hole, a vertical stop edge disposed at a back side of said bevel face and a stepped rear stop portion disposed adjacent to the associating said terminal hole.

6. An electrical plug and socket connector assembly, comprising an electrical plug connector and an electrical socket connector, wherein:

said electrical plug connector comprises:

an electrically insulative housing comprising a mating portion, a receiving chamber defined in one side of the mating portion, a plurality of partition plates arranged in two sets at an opposite side of the mating portion, a plurality of insertion slots respectively defined between each two adjacent partition plates of each of the two sets of partition plates, a plurality of terminal holes formed in the mating portion and respectively disposed in communication between the insertion slots and the receiving chamber, and a plurality of springy hooks extended from said mating portion and respectively suspending in top and bottom sides in each of said insertion slots; and a plurality of conducting terminals respectively mounted in the insertion slots of the electrically insulative housing of said electrical plug connector, each conducting terminal of electrical plug connector comprising two side panels arranged in a substantially parallel manner and defining therebetween a gap, a connection portion connected between one end of each of the two side panels, two contact end portions respectively forwardly extended from respective opposite ends of the two side panels and engaged into one respective terminal hole of the electrically insulative housing of the electrical plug connector, and a plurality of bonding pegs respectively downwardly extended from respective bottom edges of the side panels;

said electrical socket connector comprises:

an electrically insulative housing comprising a mating portion, a plurality of partition plates arranged in two sets at a rear side of the mating portion, a plurality of insertion slots respectively defined between each two adjacent partition plates of each of the two sets of partition plates, and a plurality of terminal holes formed in a front side of the mating portion and respectively disposed in communication with the insertion slots; and a plurality of conducting terminals respectively mounted in the insertion slots of the electrically insulative housing of said electrical socket connector, each conducting terminal of said electrical socket connector comprising two side panels arranged in a substantially parallel manner and defining therebetween a gap, a connection portion connected between respective rear ends of the two side panels, two contact end portions respectively forwardly extended from respective front ends of the two side panels and inserted into one respective terminal hole of the electrically insulative housing of the electrical socket connector, a receiving space defined between the two contact end portions in communication with the gap between the two side panels for receiving one respective conducting terminal of a mating electrical plug connector, a plurality of fins respectively extended from opposing top and bottom edges of said side panels and hooked in said insertion slots by said springy hooks, and a plurality of bonding pegs respectively downwardly extended from respective bottom edges of the side panels;

wherein said fins are extended from the two opposite topmost edges of said side panels towards each other and arranged alternatively.

7. The electrical plug and socket connector assembly as claimed in claim 6, wherein each contact end portion of each conducting terminal of said electrical plug connector defines a rear inflection surface obliquely inwardly extended from the associating said side panel, a middle planar surface forwardly extended from said rear inflection surface, and an inwardly inclined front guide surface inwardly extended from a front side of said middle planar surface opposite to said rear inflection surface.

8. The electrical plug and socket connector assembly as claimed in claim 6, wherein each said fin of each conducting terminal of said electrical plug connector extends from one side panel of the respective conducting terminal toward the other side panel of the respective conducting terminal; the fins of each conducting terminal of said electrical plug connector are alternatively extended from the side panels of the respective conducting terminal.

9. The electrical plug and socket connector assembly as claimed in claim 6, wherein each said fin of each conducting terminal of said electrical socket connector extends from one side panel of the respective conducting terminal toward the other side panel of the respective conducting terminal; the fins of each conducting terminal of said electrical socket connector are alternatively extended from the side panels of the respective conducting terminal.

* * * * *